US008967246B2

(12) United States Patent
Osaland et al.

(10) Patent No.: US 8,967,246 B2
(45) Date of Patent: Mar. 3, 2015

(54) DOWNHOLE ACTUATOR

(75) Inventors: Espen Osaland, Sandnes (NO); Lasse Haugland, Bryne (NO)

(73) Assignee: Altus Intervention AS, Stavanger (NO)

( * ) Notice: Subject to any disclaimer, the term of this patent is extended or adjusted under 35 U.S.C. 154(b) by 599 days.

(21) Appl. No.: 13/130,489

(22) PCT Filed: Nov. 18, 2009

(86) PCT No.: PCT/NO2009/000393

§ 371 (c)(1),
(2), (4) Date: May 20, 2011

(87) PCT Pub. No.: WO2010/062186

PCT Pub. Date: Jun. 3, 2010

(65) Prior Publication Data

US 2011/0220346 A1 Sep. 15, 2011
US 2012/0090832 A9 Apr. 19, 2012

(30) Foreign Application Priority Data

Nov. 25, 2008 (NO) ..... 20084926

(51) Int. Cl.
*E21B 23/00* (2006.01)
*E21B 31/20* (2006.01)

(52) U.S. Cl.
CPC ..... *E21B 31/20* (2013.01); *E21B 23/00* (2013.01)
USPC ..... 166/237; 166/242.6; 166/381

(58) Field of Classification Search
USPC ..... 166/237, 242.6, 301, 98, 255.1, 381
See application file for complete search history.

(56) References Cited

U.S. PATENT DOCUMENTS

| | | | | |
|---|---|---|---|---|
| 4,830,109 | A * | 5/1989 | Wedel | 166/277 |
| 5,242,201 | A | 9/1993 | Beeman | |
| 5,305,833 | A * | 4/1994 | Collins | 166/386 |
| 5,361,844 | A * | 11/1994 | Taylor et al. | 166/301 |
| 5,413,173 | A * | 5/1995 | Mills et al. | 166/212 |
| 6,059,336 | A * | 5/2000 | Meronek | 294/199 |
| 6,827,148 | B2 * | 12/2004 | Shaw et al. | 166/381 |
| 2009/0145604 | A1 * | 6/2009 | Ragab | 166/301 |
| 2010/0116492 | A1 * | 5/2010 | Beard et al. | 166/255.1 |

FOREIGN PATENT DOCUMENTS

WO WO 2007/091218 A2 8/2007

* cited by examiner

*Primary Examiner* — Kenneth L Thompson
(74) *Attorney, Agent, or Firm* — Gable Gotwals

(57) ABSTRACT

An actuator for connecting to and displacing of a component in a well tubular is disclosed. The actuator includes a tool shaft provided with a radial direction spring-loaded gripping device which are complementary fitting in the component.

5 Claims, 3 Drawing Sheets

DOWNHOLE ACTUATOR

CROSS-REFERENCE TO RELATED APPLICATIONS

This application is the United States National Phase of PCT Patent Application No. NO2009/000393 filed on 18 Nov. 2009, which was published in English on Jun. 3, 2010 under Publication No. WO 2010/062186 A1, which claims priority to Norwegian Patent Application No. 20084926 filed 25 Nov. 2008, both of which are incorporated herein by reference.

This invention relates to an actuator. More particularly it concerns an actuator for connection to and displacing of a component in a well tubular, as the tubular comprises a driver and a working organ.

During work in a borehole such as in a petroleum well it is often necessary to be able to displace a component positioned in the well. The component may typically be a control for a valve.

Control of this type is typically constituted by a concentric sleeve in a well tubular where in the sleeve wall is arranged gripping openings for connecting control equipment, and where the control equipment is arranged to be able to displace the control. Prior art control equipment is adapted to the internal diameter of the control and provided with grippers fitting in the gripper openings.

For various well technical reasons restrictions may be arranged upstream of the valve in the well tubular. The restrictions may be formed having a considerably smaller internal diameter than the well tubular. In a well tubular of 118 mm internal diameter there may for example be a restriction having 76 mm internal diameter. The restriction prevents the valve being operated by means of known control equipment, as the access to the valve is prevented by the restriction.

The object of the invention is to remedy or reduce at least one of the prior art drawbacks.

The object is achieved according to the invention by the features stated in the below description and in the following claims.

An actuator according to the invention for connection to and displacing of a component in a well tubular comprising a driver and a working organ, is characterised in that the working organ is provided with an in the radial direction spring loaded gripping device complementary fitting in the component.

The actuator is in a per se known way connected to such as a cable, a wireline tractor or a coiled tubing.

The spring loaded gripping device has a radial displacement length making passing a restriction possible and also the following connection to and displacing of the component having a considerably larger internal diameter than the restriction.

The gripping device may be connected to a leaf spring where the leaf spring is preloaded in the radial direction outward from the well tubular central axis.

The gripping device is thus positioned closer to the well tubular central axis in its passive position than in its active position.

The gripping device may be held in its passive position by means of a releasing device where the releasing device on release allows that the gripper device is displaced spring-loaded to its active position. On return of the releasing device to its passive position the gripping device is displaced outward from its engagement with the component.

A sleeve abutting and being displaceable relative to the leaf spring may constitute the releasing device. By adapting the releasing device internal diameter, the releasing device holds the leaf spring and the gripping device in the passive position when the releasing device encircles the leaf spring.

The releasing device may be connected to the driver and the leaf spring may be connected to the working organ. When the driver displaces the working organ relative to the driver the leaf spring is first displaced out of the releasing device whereby the leaf spring displaces the gripping device radially to engagement with the component. A further displacement of the working organ relative to the driver causes the component to be displaced relative to the well tubular.

The gripping device rear portion may have an angle relative to the well tubular central axis less than 90 degrees. The actuator may thereby be withdrawn outward through the restriction even if the driver should fail.

An actuator in accordance with the invention makes operation of components in a well tubular possible even if the component is positioned further down in the well than a restriction. It is self-evident that it is technically and economically very advantageous to be able to operate the component without first having to remove the restriction.

In the following is described an example of a preferred embodiment being illustrated in the accompanying drawings wherein.

Figure 1:
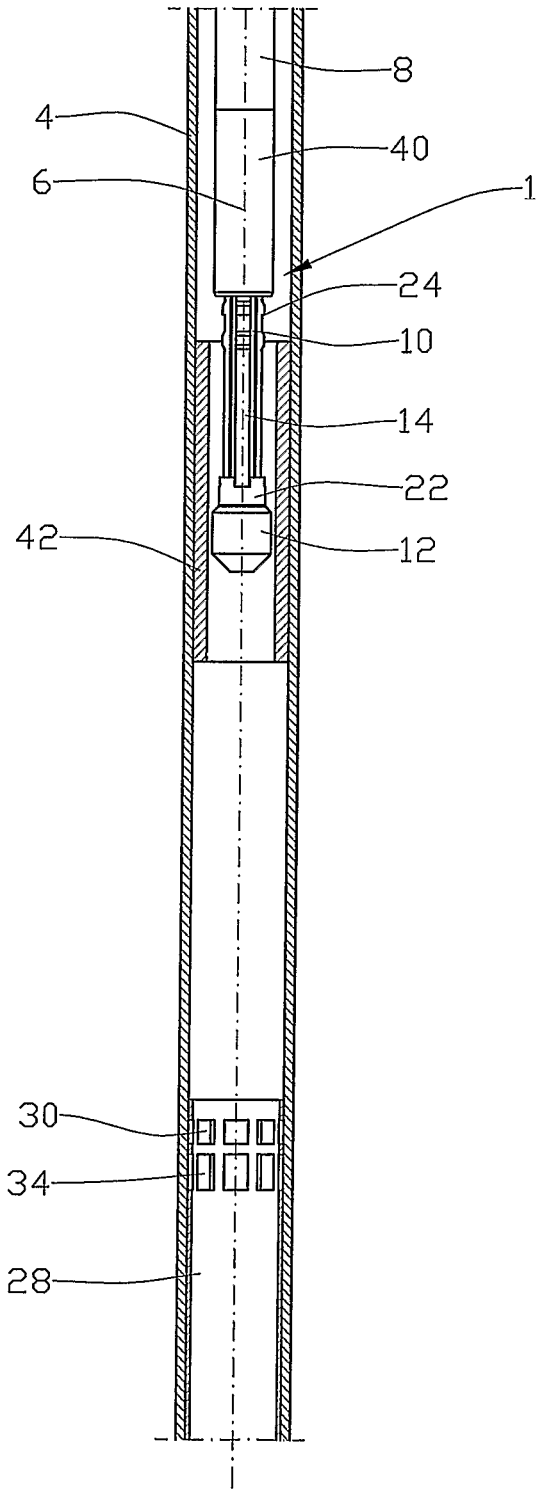
FIG. 1 shows an actuator in accordance with the invention during displacement in a restriction in a well tubular.

In the drawings the reference numeral 1 indicates an actuator connected to a wireline tractor 2 positioned in a well tubular 4. The well tubular 4 has a central axis 6.

The actuator 1 comprises a driver 8 for example in the form of an electric or hydraulic power unit which in a per se known way is arranged to be able to displace a working organ 10 in a direction along the well tubular 4 central axis 6.

The working organ 10 is in its free end portion provided with a steering guide 12 arranged to be able to steer the actuator 1 during displacing of the well tubular 4.

Figure 3:
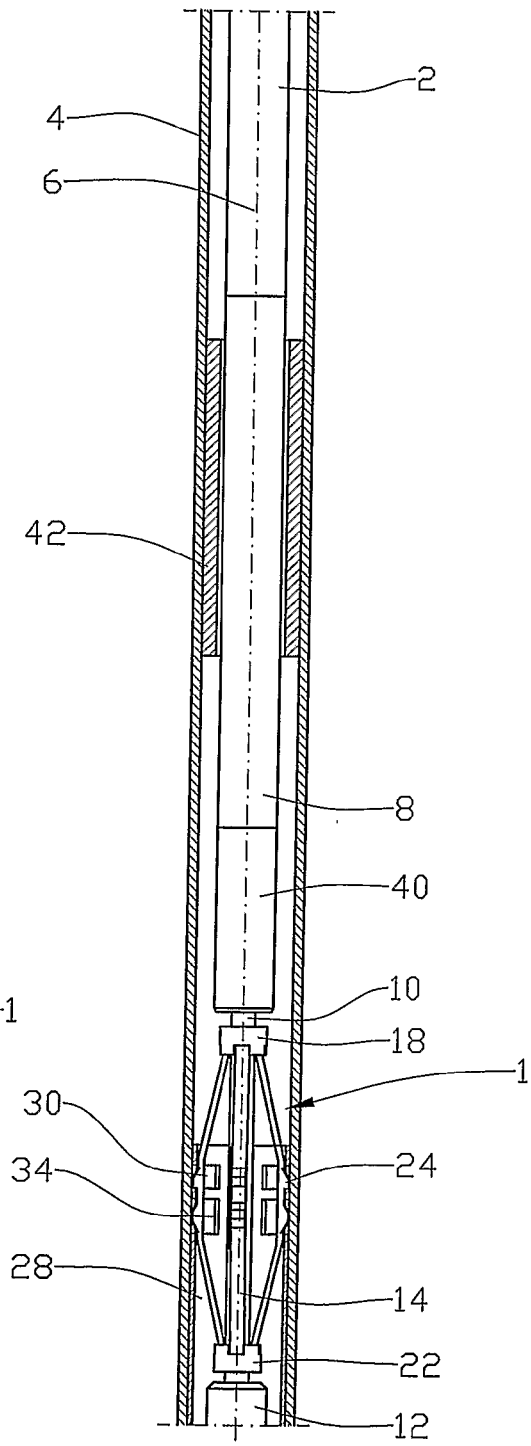
FIG. 3 shows the actuator after the component is displaced.
Figure 4:
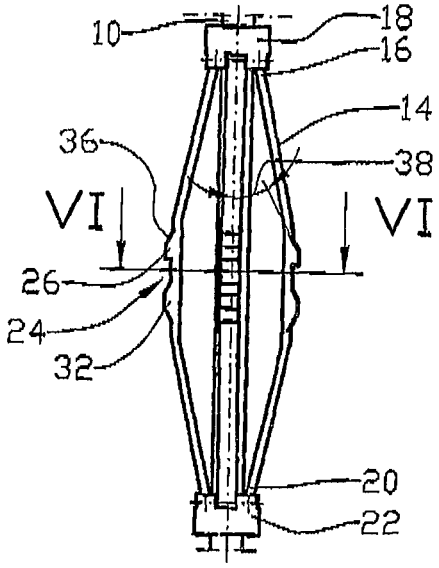
FIG. 4 shows a section of the actuator to a larger scale.
Figure 5:
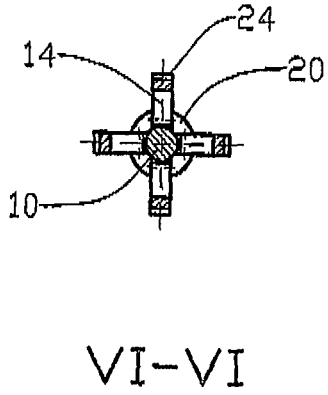
FIG. 5 shows a cross-section VI-VI in FIG. 4.

Four outwardly curved leaf springs 14 are at their first end portions 16 articulateably connected to a to the working organ 10 fixedly connected first attachment 18, see FIGS. 3 and 4. In their opposing second end portions 20 the leaf springs 14 are articulateably connected to a second attachment 22, which is displaceable on the working organ 10.

Figure 2:
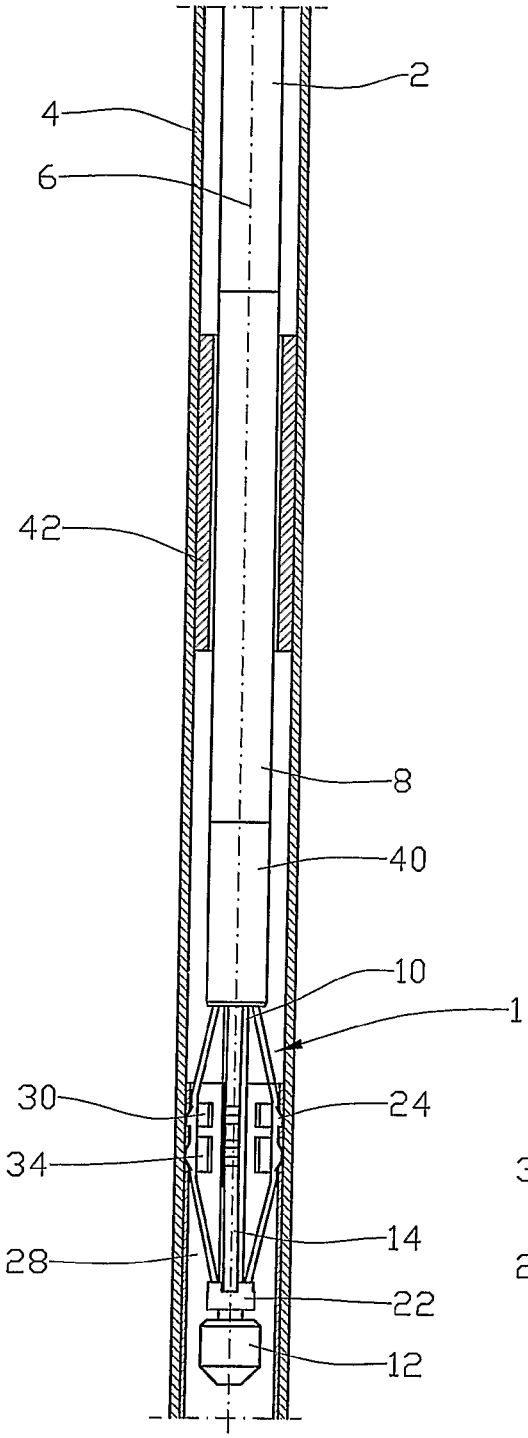
FIG. 2 shows the actuator where the actuator gripper device is in engagement with a component.

The leaf springs 14 are at their mid portion given one each gripping device 24 in the form of a gripping bulb 26 arranged to be able to engage the gripping recesses 30 of a component 28, see FIG. 2. The gripping device 24 is also provided with steering bulb 32 arranged to be able to prevent that the gripping device 24 unintentionally engages during displacement in the well tubular 4.

The steering bulb 12 must be placed in a steering recess 34 in the component 28 for the gripping bulb to engage the gripping recesses 30.

The rear portion 36 of the gripping device 24 has an angle 38 with the central axis 6 being less than 90 degrees and preferably less than 45 degrees.

A releasing device 40 in the form of a sleeve encircles the working organ 10. The releasing device 40 is connected to the driver 8. When the leaf springs 14 are pulled into the releasing device 40, see FIG. 1, the gripping devices 24 are positioned in their passive position near the central axis 6. When the leaf springs 14 are displaced at least partly out of the releasing device 40, the gripping devices 24 are positioned in their active position, see FIGS. 2 and 3.

In FIG. 1 the actuator is being displaced through a restriction 42 in the well tubular 4. The leaf springs 14 are positioned pushed into the releasing device 40.

In FIG. 2 the leaf springs 14 are displaced out of the releasing device 40 by means of the working organ 10. The leaf springs 14 have displaced the gripping devices 24 into engagement with the component 28.

In FIG. 3 the working organ 10 has displaced the gripping devices 24 and thereby the component 28 inward into the well tubular 4.

By pulling the leaf springs 14 into the releasing device 40 the gripping devices 24 are deactivated whereafter the actuator 1 may be displaced back through the restriction 42.

Should the actuator 1 driver 8 fail, the actuator may still be pulled out through the restriction 42. If the actuator 1 is pulled out through the restriction 42 without the gripping devices 24 being brought back to their passive position, then the gripping devices 24 will be resiliently displaced out from their engagement with the component 28, whereafter the leaf springs 14 abut the restriction 42. This causes the gripping devices 24 to be displaced in a direction toward the central axis 6 of the well tubular 4. Due to its shape the gripping device 24 will be displaced further in the same direction when it abuts the restriction 42.

Figure 6:
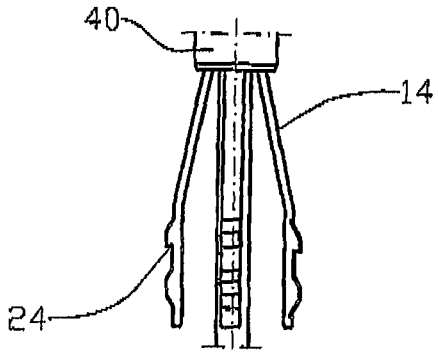
FIG. 6 shows a section of the actuator in an alternative embodiment.

In an alternative embodiment, see FIG. 6, the gripping devices 24 are positioned on the free end portions of their respective springs 44. The springs 44 are fixedly connected to the first attachment 18. This simplified embodiment does however not have the same strength as the preferred embodiment, but may in some cases be relevant due to its reduced construction length.

The invention claimed is:

1. An actuator for connecting to and displacing of a component in a well tubular, where the actuator comprises a driver and a tool shaft, where the driver is able to displace the tool shaft relative to the driver in a direction along a central axis of the well tubular, and where outwardly projecting gripping devices, that are spring loaded in the radially outward direction by a preloaded leaf spring, in their active position are complementary fitting in recesses in the component by an outward movement of the gripping devices, wherein a releasing device includes a sleeve that is encircling and displaceable relative to the leaf spring and the tool shaft, and the leaf spring is in its passive position when pulled into the releasing device in the axial direction, and where the leaf spring at a first end portion is connected to a fixedly connected first attachment of the tool shaft.

2. The actuator according to claim 1, wherein the gripping device, in its passive position, is closer to a central axis of the well tubular than in its active position.

3. The actuator according to claim 1 wherein the releasing device is connected to the driver.

4. The actuator according to claim 1 wherein a rear portion of the gripping device has an angle relative to the central axis of the well tubular that is less than 90 degrees.

5. The Actuator according to claim 1 wherein the leaf spring at the first end portion is articulateably connected to the tool shaft's fixedly connected first attachment.

* * * * *